US010336488B1

(12) United States Patent
Kjelson

(10) Patent No.: US 10,336,488 B1
(45) Date of Patent: Jul. 2, 2019

(54) VACUUM SEAL APPARATUS AND METHOD

(71) Applicant: Michael Kjelson, Chicago, IL (US)

(72) Inventor: Michael Kjelson, Chicago, IL (US)

( * ) Notice: Subject to any disclaimer, the term of this patent is extended or adjusted under 35 U.S.C. 154(b) by 0 days.

(21) Appl. No.: 15/921,402

(22) Filed: Mar. 14, 2018

(51) Int. Cl.

| | |
|---|---|
| ***B65B 31/04*** | (2006.01) |
| ***B65D 33/25*** | (2006.01) |
| ***B65D 81/20*** | (2006.01) |
| ***B65D 77/04*** | (2006.01) |
| ***B65D 33/01*** | (2006.01) |
| ***B65B 31/00*** | (2006.01) |

(52) U.S. Cl.
CPC ..... *B65B 31/048* (2013.01); *B65B 31/00* (2013.01); *B65D 33/01* (2013.01); *B65D 33/2508* (2013.01); *B65D 77/04* (2013.01); *B65D 81/2038* (2013.01)

(58) Field of Classification Search
CPC ..... B65B 31/00; B65B 31/02; B65B 31/024; B65B 31/025; B65B 31/046; B65B 31/047; B65B 31/048; B65B 2220/16; B65B 2220/18; B65B 2220/20; B65B 2230/02; B65D 31/12; B65D 33/01; B65D 77/04; B65D 77/38; B65D 81/2023; B65D 81/2038; B65D 81/2061
USPC ..... 53/432, 434, 510, 512, 527, 170, 173; 206/524.8; 229/117.3; 383/38, 39, 40, 383/44, 45, 100, 103
See application file for complete search history.

(56) References Cited

U.S. PATENT DOCUMENTS 2,930,423 A 3/1960 Cunningham et al.
5,096,092 A 3/1992 Devine
5,199,594 A * 4/1993 Obara et al. ..... B65D 31/12 383/39
5,358,142 A 10/1994 Holmes
5,628,404 A * 5/1997 Hendrix ..... B65D 81/2023 206/524.8
(Continued)

FOREIGN PATENT DOCUMENTS

CN 201801024 4/2011
CN 105173345 12/2015
(Continued)

OTHER PUBLICATIONS

Christensen, E., "Two Easy Hacks for 'Vaccum-Sealing' Bags Without a Vaccum Sealer", Aug. 23, 2013, http://www.thekitchn.com/two-tricks-for-vacuumsealing-freezer-bags-without-a-vacuum-sealer-tips-from-the-kitchn-194038, pp. 1-2.
(Continued)

*Primary Examiner* — Stephen F. Gerrity
(74) *Attorney, Agent, or Firm* — Scott M. Garrett; Scott D. Smiley; The Concept Law Group

(57) ABSTRACT

A pressure sealing apparatus includes a hermetically sealable bag having an exit valve that allows air to exit the bag once sealed, and which prevents air from entering the bag. An item placed in the bag is vacuum sealed in the bag by the pressure sealing apparatus. The bag can be placed in, or integrally formed with a pressure container. The pressure container includes an exit port through which the exit valve passes, and is also sealed so that the interior of the pressure container can be pressurized. When pressurized, the pressure in the pressure container acts on the bag to squeeze air out of the bag through the exit valve, thereby vacuum sealing the item in the hermetically sealable bag.

19 Claims, 6 Drawing Sheets

(56) References Cited

U.S. PATENT DOCUMENTS

| | | | | |
|---|---|---|---|---|
| 6,234,351 | B1 | 5/2001 | Wilcox | |
| 6,513,658 | B1 * | 2/2003 | Adkins | B65D 81/052 206/522 |
| 7,516,594 | B1 * | 4/2009 | Terminella et al. | B65B 31/02 53/512 |
| 7,674,041 | B2 * | 3/2010 | Frayne | B65D 33/01 206/524.8 |
| 8,858,078 | B2 | 10/2014 | Vonwiller | |
| 2003/0168479 | A1 | 9/2003 | Lu et al. | |
| 2008/0272146 | A1 * | 11/2008 | Kaczmarek | B65D 77/04 222/105 |
| 2009/0212071 | A1 | 8/2009 | Tom et al. | |

FOREIGN PATENT DOCUMENTS

| | | |
|---|---|---|
| JP | 11227715 | 8/1999 |
| WO | 2016079248 | 5/2016 |

OTHER PUBLICATIONS

"Vacuum Seal Bag for Quilt,One Way Valve,Blue Zip Top", https://www.alibaba.com/product-detail/vacuum-seal-bag-for-guilt-one_1507710104.html, downloaded on Mar. 14, 2018, pp. 1-2.

"Pa+pe Vacuum Seal Bag for Clothes,One Way Degassing Valve Attached", https://www.alibaba.com/product-detail/PA-PE-vacuum-seal-bag-for_1705317516.html, downloaded on Mar. 14, 2018, pp. 1-5.

* cited by examiner

VACUUM SEAL APPARATUS AND METHOD

FIELD OF THE INVENTION

The present invention relates generally to storage containers and systems, and, more particularly, relates to a storage container systems configured to allow air to be removed from the container.

BACKGROUND OF THE INVENTION

There are a number of applications where it is desirable to remove air from a storage container when storing an item. One example is food storage, where, to prevent food from spoiling while stored, air is pumped out of the container. A number of devices are offered for sale that provide a vacuum sealed bag. In some vacuum seal systems, food is placed in an open plastic bag, and the open end of the bag is placed in sealing pump device which pumps air out of the bag, and then thermally seals the bag. In other arrangements, a valve device is mounted on the bag which allows air to be pumped out of the bag once the bag is closed. Another food-related application of vacuum sealing is marinating food items. The vacuum allows ambient air pressure to urge liquids surrounding the food item in the bag into the food item to affect flavor of the food item. Still another popular usage of vacuum sealed food items is in "sous vide" cooking, where the food, vacuum sealed in its bag, is placed in heated water to raise the temperature of the food item to the temperature of the water. Sous vide cooking has recently gained in popularity, and while it was initially limited to commercial restaurant cooking, home appliances known as immersion circulators have become popular for facilitating sous vide cooking at home.

However, several problems can occur with food vacuum seal systems. For one, since a pump is used to create a vacuum to draw air out of the bag, it can also draw out liquids that may be present in the bag, particularly in marinating usages. Therefore the pump needs to be designed to accommodate liquids without fouling the mechanism and causing failures. Another problem that can occur is that the food can form a seal against the inside of the bag, potentially trapping air such that air pockets remain in the bag even after the pump has reached maximum vacuum. This defeats the purpose of a "vacuum seal" storage container, which is intended to remove virtually all air, or as much as possible, from around the food. Also, there is the cost of the pump device itself, which tends to be prohibitive, and if it could be avoided, would allow people to vacuum seal food far less expensively. In general the prior art systems rely on an electrically powered pump, which either requires batteries or a commercial electrical outlet to operate. Thus, the usability of a pump is dependent on a power source.

Therefore, a need exists to overcome the problems with the prior art as discussed above.

SUMMARY OF THE INVENTION

The invention provides a vacuum seal apparatus and method that overcomes the hereinafore-mentioned disadvantages of the heretofore-known devices and methods of this general type and that avoid the cost and expense of a vacuum pump, thereby allowing vacuum sealing of food and other items at a low cost.

With the foregoing and other objects in view, there is provided, in accordance with some exemplary embodiments of the invention, a pressure sealing apparatus includes a hermetically sealable bag configured to accept an item and then to be sealed after the item is placed inside the hermetically sealable bag. The hermetically sealable bag includes an exit valve that is configured to allow air to escape from the hermetically sealable bag while preventing air from entering the hermetically sealable bag through the exit valve. The system of the exemplary embodiments can further include a pressure container that is configured to contain the hermetically sealable bag with the item therein under an airtight seal, and which has a wall having an opening through which the exit valve allows air to exit from the hermetically sealable bag, external to the pressure container. The system of the exemplary embodiment can further include an air passage formed in the wall of the pressure container that is configured to allow air to be provided into the pressure container, and external to the hermetically sealable bag, in a manner that forces air out of the hermetically sealable bag through the exit valve.

In accordance with another feature, an embodiment of the present invention includes that the pressure container can also be a hermetically sealable bag.

In accordance with a further feature of the present invention, the pressure container can be a rigid container.

In accordance with a further feature of the present invention, the exit valve can be configured to be removeably coupled to an exit tube in the wall of the pressure container.

In accordance with a further feature of the present invention, the air passage formed in the wall of the pressure container can include a coupling configured to allow for attachment to an air pump.

In accordance with a further feature of the present invention, the hermetically sealable bag can include a zip-close opening through which the item can be placed into the hermetically sealable bag.

In accordance with a further feature of the present invention, the pressure container can be a second bag, and wherein the hermetically sealable bag and the pressure container share the zip close opening.

In accordance with other exemplary embodiments of the invention, there is provided a pressure sealing container that includes body having a sealable opening formed on the body that can be open or closed. When closed, the opening is airtight. The body can further include an exit port that is configured to accept an exit valve of a hermetically sealable bag while the hermetically sealable bag is inside the pressure sealing container. The pressure sealing apparatus can further include an air passage formed in the body of the pressure container that is configured to allow air to be provided into the body, external to the hermetically sealable bag, in a manner that forces air out of the hermetically sealable bag through the exit valve.

In accordance with a further feature of the present invention, the exit port is sized to allow a portion of the exit valve extend through the exit port, external to the body, and to form a seal around the portion of the exit valve extended through the exit port. In accordance with a further feature of the present invention, a threaded nut can be configured to thread onto the portion of the exit valve that extends through the exit port, and forms the seal through compression.

In accordance with the present invention, a method for sealing an item in a bag is provided, where the bag has a sealable opening and an exit valve that allows air to exit the bag when the sealable opening is sealed closed. The exit valve also prevents air from thereafter entering the bag through the valve. The method includes: placing the item in the bag, and then sealing the opening of the bag. The method can further include placing the bag in a pressure sealing container, and arranging the bag in the pressure sealing container so that an exit valve of the bag is operably interfaced with an exit port of the pressure sealing container. The method can further include pressurizing an interior of the pressure sealing container, thereby causing air to be expelled from the bag through the exit valve, external to the pressure sealing container, and producing a vacuum effect inside the bag.

Although the invention is illustrated and described herein as embodied in a vacuum seal apparatus and method, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Those skilled in the art can understand the specific meanings of the above-mentioned terms in the embodiments of the present invention according to the specific circumstances

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
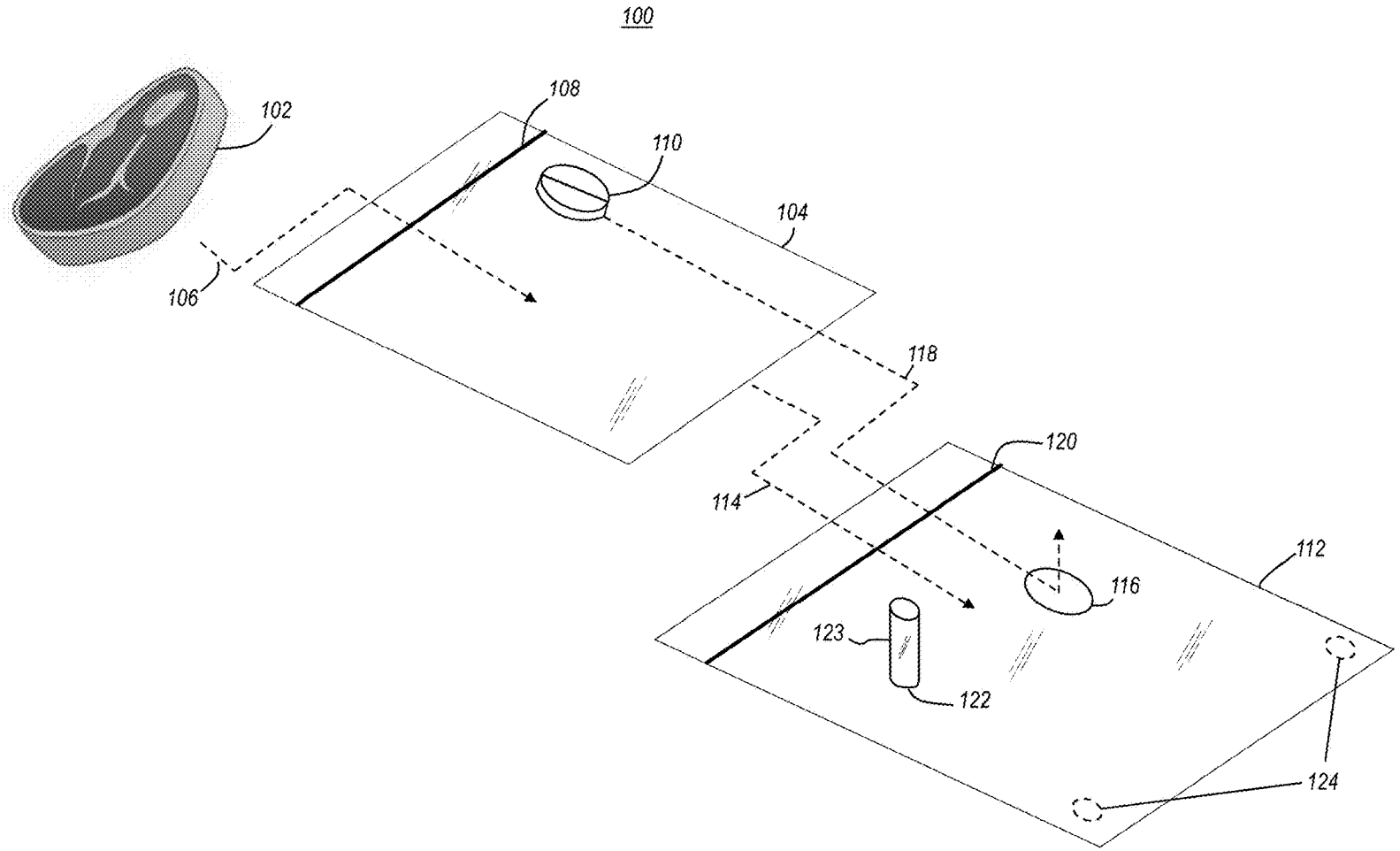
FIG. 1 is a exploded view of a pressure sealing apparatus for vacuum sealing, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Embodiments of the present invention provide a novel and efficient pressure sealing apparatus to vacuum seal items such as food. Embodiments of the invention provide a pressure sealing apparatus that includes a hermetically sealable bag configured to accept an item and then to be sealed after the item is placed inside the hermetically sealable bag.

The hermetically sealable bag includes an exit valve configured to allow air to escape from the hermetically sealable bag while preventing air from entering the hermetically sealable bag through the exit valve. The pressure sealing apparatus further includes a pressure container configured to contain the hermetically sealable bag with the item therein. The pressure container includes a wall having an opening through which the exit valve allows air to exit from the hermetically sealable bag while preventing air from entering the hermetically sealable bag. The pressure container further includes an air passage formed in the wall of the pressure container that is configured to allow air to be provided into the pressure container, external to the hermetically sealable bag, in a manner that forces air out of the hermetically sealable bag through the exit valve.

In addition, some embodiments of the invention provide a method of sealing an item in a bag that has a sealable opening and an exit valve that allows air to exit the bag when sealed, and which prevents air from thereafter entering the bag. The method includes placing the item in the bag, and sealing an opening of the bag. The method further includes placing the bag in a pressure sealing container and arranging the bag in the pressure sealing container so that an exit valve of the bag is operably interfaced with an exit port of the pressure sealing container. In some embodiments the pressure container can be another bag, and the two bags are joined together so that the first bag, in which the item is placed, is integrally formed as an internal bag to the pressure sealing container (e.g. an outer bag). The pressure sealing container is closed, and the method further includes pressurizing an interior of the pressure sealing container, thereby causing air to be expelled from the bag through the exit valve, external to the pressure sealing container and producing a vacuum effect inside the bag.

Figure 2:
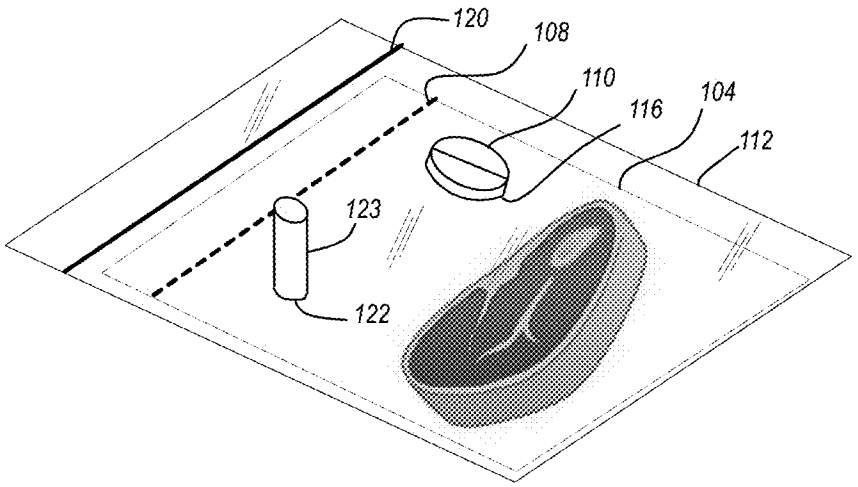
FIG. 2, is a view of an assemble pressure sealing apparatus, in accordance with some embodiments.

Referring now to FIG. 1, one embodiment of the present invention is shown in an exploded view of a pressure sealing apparatus 100 for vacuum sealing, in accordance with some embodiments. FIG. 2 shows the pressure sealing apparatus of FIG. 1 in an assembled state. The pressure sealing apparatus 100 can be used, for example, to vacuum seal a food item 102, although any item that can fit in the pressure sealing apparatus 100 can be vacuum sealed. As used herein the term "vacuum seal" refers to enclosing the item in a hermetically sealable, flexible container and driving air out of the container, leaving the item sealed in the container with little to no air, or at least under a negative pressure relative to the ambient atmospheric pressure. It is not necessary, however, to use a vacuum, as will be explained. In the present example of FIG. 1, the food item 102 can be placed into a hermetically sealable bag 104 as indicated by arrow 106. The bag 104 can be made of plastic, such as a polypropylene plastic resin, as is common for commercially available food bags. Once placed in the bag 104, the bag 104 can be sealed closed such as by a zip close feature 108. The bag 104 has an exit valve 110 that allows air to exit from inside the bag. The exit valve is a one-way valve which prevents air from entering back into the bag 104. The bag can be placed inside a pressure container, such as another bag 112, as indicated by line 114, which can be made out of the same material as bag 104. Bag 112 includes an exit port 116 that is an opening in the wall of the bag 112 that is shaped to interface with the exit valve 110, as indicated by line 118, in a way that forms a seal such that air inside bag 112 won't escape through exit port 116 when the air inside bag 112 is pressurized. Bag 112 further includes an air passage 122, which is a second opening in the wall of bag 112, which allows air to be provided into the interior of the bag 112. The air passage 122 can be coupled to a device for facilitating the input of air into bag 112, such as, for example, a tube 123, which is sealed at the air passage 122 to prevent air leaking out past the interface of air passage 122 and tube 123. As shown, the air passage 122 is located closer to a top end of the bag 112, but can alternatively be located at other places on the bag 112, such as near one of the lower corners, as indicated by dashed circles 124. In some embodiments it may be desired to separate the air passage 122 from the bag 104 as much as possible to avoid exposure to anything that may be on the exterior of bag 104. The air passage Once bag 104, including food item 102, is sealed inside of bag 112, then bag 112 can be sealed closed, such as by a zip close feature 120, as shown in FIG. 2.

As shown in FIG. 2, bag 104 in inside bag 112, and contains food item 102. Both bags 104, 112 are sealed closed. The exit valve 110 is interfaced with exit port 116, and extends through exit port 116. Air can then be provided into bag 112 through air passage 122 and tube 123, thereby pressurizing the interior of bag 112. This pressure exerts force on the exterior of bag 104, and forces air out of bag 104 through the exit valve 110 to the exterior of bag 112. Since exit valve 110 is a one-way valve, the result is that the food item inside bag 104 is vacuum sealed inside bag 104. Thus, rather than applying a negative pressure to the inside of bag 104, as is conventional in vacuum sealing, the pressure sealing apparatus 100 applies a positive pressure, in excess of the ambient atmospheric pressure, to the outside of the bag 104 to essentially squeeze it across the entirety of its exterior, thereby forcing air out of it. By using positive pressure, problems associated with the prior art are avoided. For example, if liquids are expelled through the exit valve 110, they can simply be wiped up, and do not because a potential contaminant in a vacuum pump device since none is used. Also, by applying an even positive pressure around the entirety of bag 104, the formation of air pockets like those that can form when using a negative pressure vacuum system are avoided since a negative pressure system can result in portions of the bag sealing to the food item and trapping air. Furthermore, because the positive pressure squeezes the food item, it can better expel air or other gasses from the food item than a negative pressure system.

Figure 3:
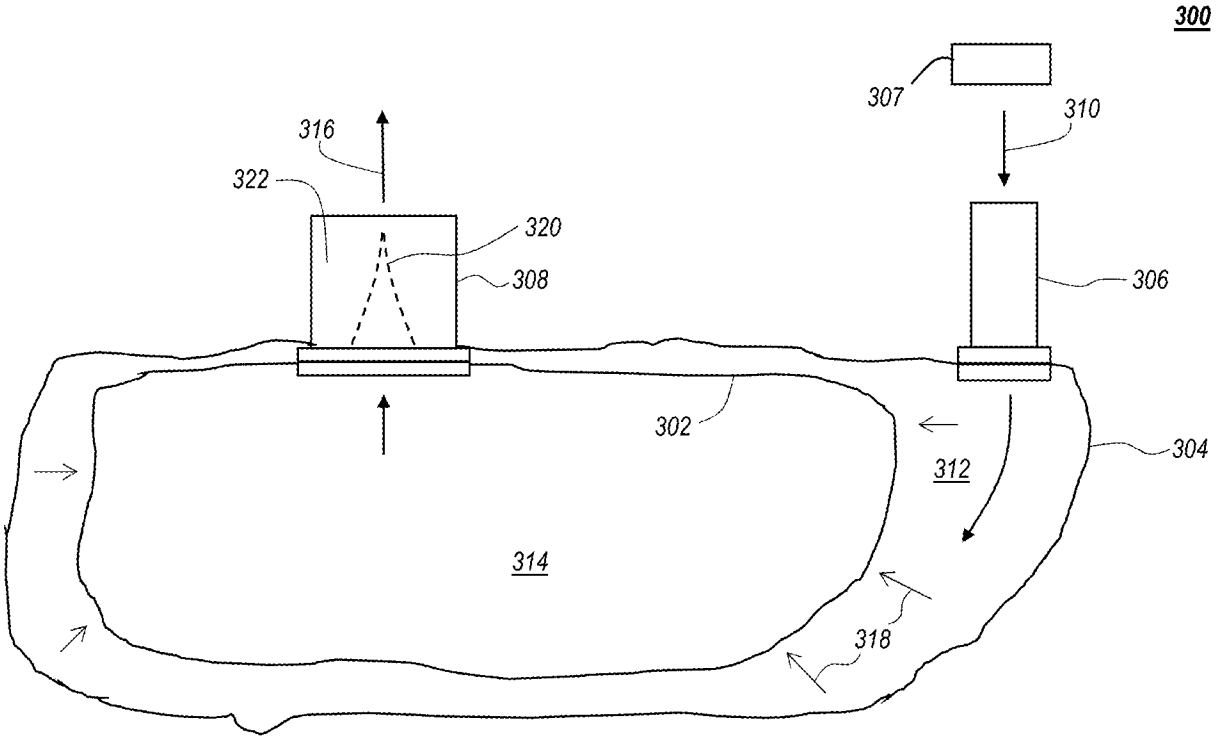
FIG. 3 is a cutaway view of a pressure sealing apparatus, in accordance with some embodiments, looking from a top orientation.

FIG. 3 is a cutaway view 300 of a pressure sealing apparatus, in accordance with some embodiments, looking from a top orientation. The cutaway view 300 can be a cutaway view of the pressure sealing apparatus 100 of FIGS. 1&2. Here, however, for the sake of clarity, there is nothing inside like food item 102. A hermetically sealable bag 302 is disposed inside a pressure container such as an exterior bag 304. The hermetically sealable bag 302 and exterior bag 304 can be zip close plastic bags. Bag 302 has an interior 314 in which an item (not shown) to be vacuum sealed can be placed. Likewise, bag 304 has an interior 312 in which bag 302 is disposed. Air is provided under positive pressure though tube 306, though an air passage opening in the wall of bag 304 as indicated by arrow 310. The air can be provided simply by a person blowing into the tube 306, with their mouth forming a seal around the tube 306. In some embodiments a cap 307 can be used to cover the free end of the tube 306 when the tube is not in use to prevent contaminants and other matter from getting into the tube 306. As air enters the interior 312 of the bag 304, pressure increases around bag 302 as indicated by arrows 318. As a result of the pressure in the interior 312 of bag 304, air and other matter is expelled out of bag 302, though exit valve assembly 308 exterior to bag 304, as indicated by arrow 316. Exit valve assembly 308 includes a one way valve 320 that only allows air to exit the bag 304 in the direction of arrow 316. Examples of one way valves can include reed valves and duckbill valves. Duckbill valves can be especially suited to this purpose as they are one-piece, elastomeric components that act as backflow prevention devices or one-way valves or check valves. They have elastomeric lips in the shape of a duckbill which prevent backflow and allow forward flow. Thus, the negative pressure inside the bag 302 assists the ambient pressure outside bag 304 to seal the valve 320. Any liquids that are expelled can be retained in the valve assembly in cavity 322 to prevent leaks.

Figure 4:
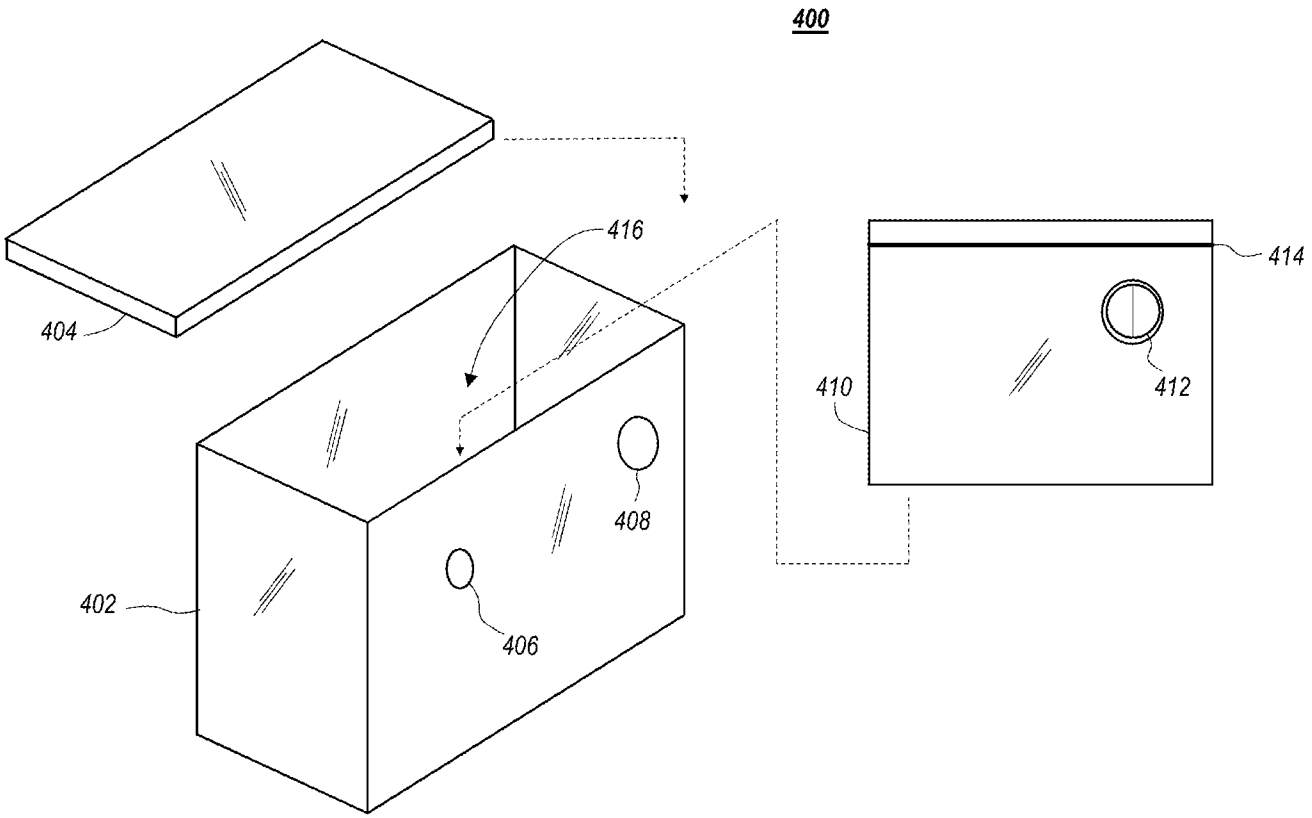
FIG. 4 is an exploded view of a pressure sealing apparatus including a pressure container having a rigid body, in accordance with some embodiments.

FIG. 4 is an exploded view of a pressure sealing apparatus 400 including a pressure container 402 having a rigid body, in accordance with some embodiments. In FIGS. 1-3 the pressure container is exemplified as a plastic bag, here it is a rigid container. The pressure container 402 includes a lid 404 that forms a pressure seal with the body of the container 402. The pressure container 402 includes an opening for an air passage 406 to allow air into the interior 416 of the container 402, as well as an exit port 408. The air passage 406 can be located anywhere on the body of the container 402, but in some embodiments the air passage 406 can be located so as to maximize the separation between the air passage 406 and the hermetically sealable bag when the hermetically sealable bag is placed in the container 402. A hermetically sealable bag 410 can be used to contain one or more food items for storage or other use. The bag 410 include an exit valve 412 that interfaces with exit port 408 in a way the prevents air from leaking out of container 402 around the exit valve 412 through exit port 408. The bag 410 is placed into the interior 416 of the container 402, with exit valve 412 sealed and interfaced with exit port 408. Lid 404 is then placed onto the container 402 to seal the interior 416. Air is then provided into the air passage 406 to pressurize the interior 416 of the container 402, forcing air inside bag 410 to exit through the exit valve 412. The air provided through air passage 406 can be provided by, for example, a person blowing into a tube interfaced with air passage 406, or via a positive pressure air pump, or other means of creating a positive air pressure inside container 402.

Figure 5:
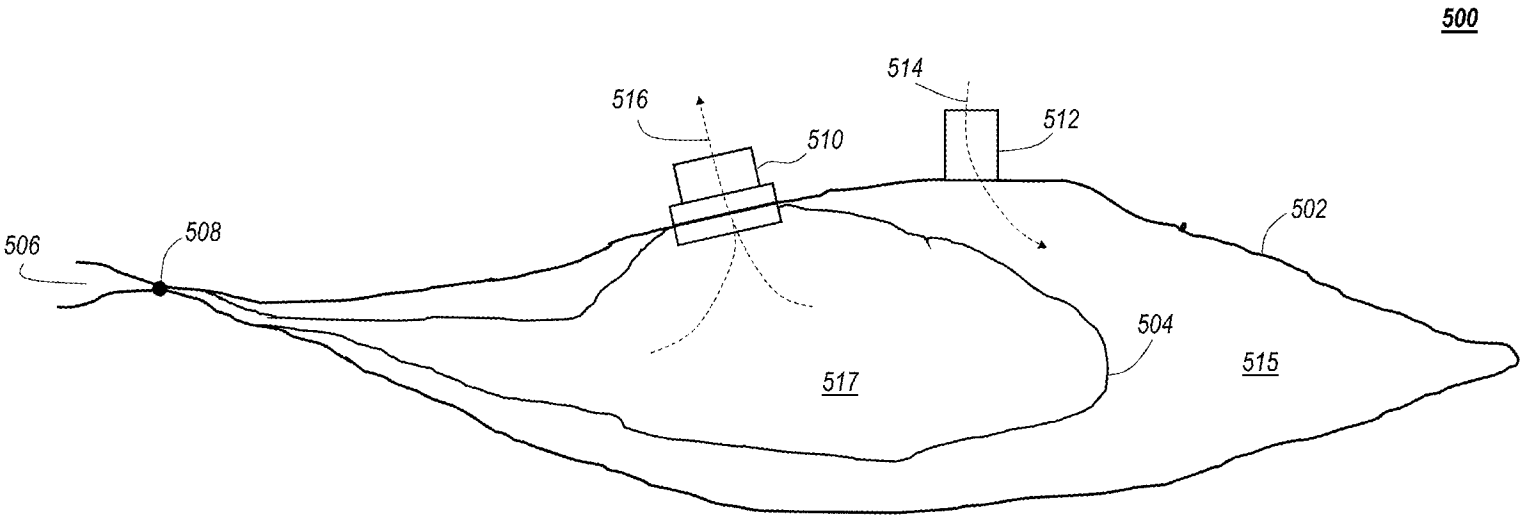
FIG. 5 is a side cutaway view of a unitary pressure sealing apparatus having an inner bag and an outer bag that share a closure, in accordance with some embodiments.

FIG. 5 is a side cutaway view of a unitary pressure sealing apparatus 500 having an inner bag 504 and an outer bag 502 that share a closure 508, in accordance with some embodiments. In embodiments exemplified in FIG. 5, the outer bag 502 acts as a pressure container for inner bag 504, and both bags can be made of conventional plastic bag material. However, rather than being separate bags, as in FIGS. 1-2, here the outer and inner bags 502, 504 are integrally configured, such that opening 506 opens to the interior 517 of inner bag 504 only, and inner bag 504 is in the interior of outer bag 502. A seal 508, which can be a zip close seal, can be used to seal the inner bag 504 after an item is placed in it.

Once sealed at seal 508, air can be provided into air passage 512 as indicated by arrow 514, pressurizing the interior 515 of the outer bag 502. The pressure in interior 515 is experienced on inner bag 504, causing air in inner bag 504 to exit out of inner bag through exit valve 510, as indicated by arrow 516. Exit valve 510 allows air to exit the interior of inner bag 504 through the outer bag 502 as well, while preventing air from entering inner bag 504, thereby creating a vacuum seal of the item in the interior 517 of inner bag 504. Air 514 can be provided by a user blowing into the air passage 512 where the air passage 512 is formed as an integrally connected tube, similar to a straw of other similar device that facilitates a person being able to inflate the outer bag 502. Once the inner bag 504 is sealed and air is driven out, then the interior 515 of outer bag 515 can be deflated through air passage 512. Thus, air passage 512 does not need to be a one way valve.

By deflating outer bag 502 after pressurizing and vacuum sealing inner bag 504, the apparatus 500 can be put away for storage/refrigeration as a unit. When a person then wants to use the item sealed in inner bag 504, seal 508 can be opened, allowing air back into inner bag 504, and item can be removed for use. Then the apparatus 500 can be washed and reused.

Figure 6:
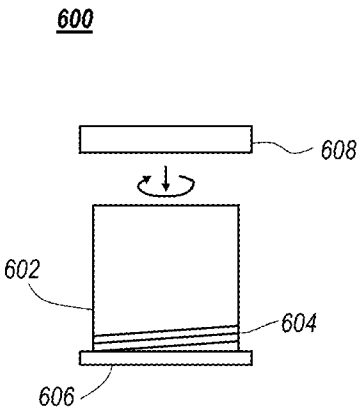
FIG. 6 is a side elevational view of an exit valve having a threaded portion, in accordance with some embodiments.

FIG. 6 is a side elevational view of an exit valve 600 having a threaded portion 604, in accordance with some embodiments. The valve 600 can be similar to valve 110 of FIG. 1 or 510 of FIG. 5, and allows air in a hermetically sealable bag to exit out of the bag and through an exit port of a pressure container in which the bag is placed or located. The exit valve 600 includes a tube portion 602 in which a one-way valve mechanism, such as a reed valve, is disposed. The tube 602 has a diameter that is about the size of an exit port through the bag and pressure container in which the bag is located. At a bottom of the tube 602 is a shoulder 606 having a larger diameter that the tube 602. A nut 608 fits over the tube 602 and has threads corresponding to threads at the threaded portion 604. The tube in inserted, from inside the bag, through the exit ports of the bag and the pressure container. The shoulder 606 stops the tube and bears against in inner surface of the bag, while the threaded portion 604 is external to both the bag and the pressure container. Thus, nut 608 is placed on the tube 602, and threaded onto threaded portion 604, exerting pressure between the nut 608 and shoulder 606 to create a seal.

The arrangement of FIG. 6 allows removal of the valve 600 from the bag and pressure container for use in other bags. Thus, if one bag wears out or becomes damages, the valve 600 can be reused. In other embodiments the valve can be more permanently attached to the bag. For example, the shoulder 608 of the valve 600 can be heat staked to the material of the bag and pressure container to create a seal.

Figure 7:
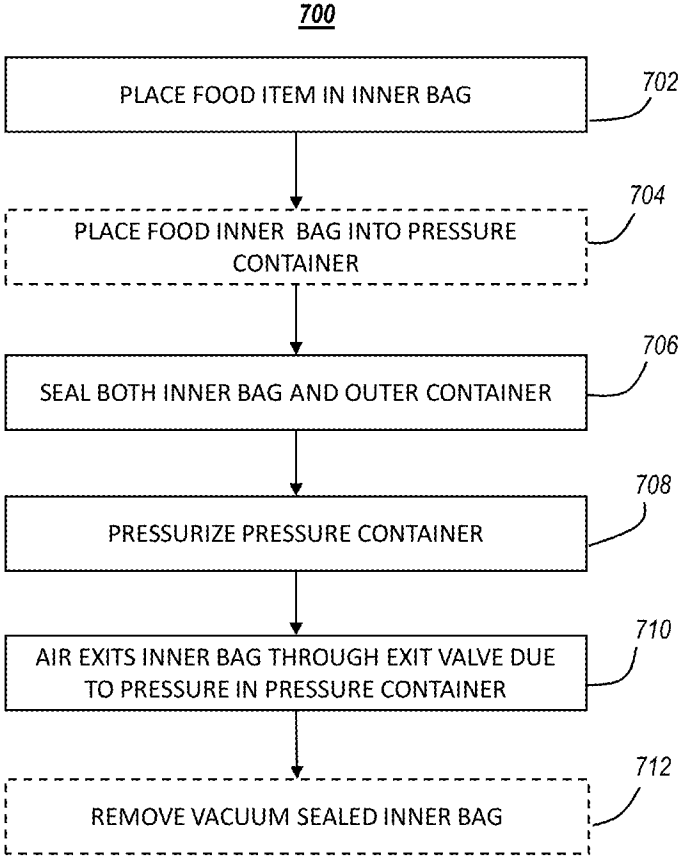
FIG. 7 is a flow chart diagram illustrating a method of using a pressure sealing apparatus, in accordance with some embodiments.

FIG. 7 is a flow chart diagram illustrating a method 700 of using a pressure sealing apparatus, in accordance with some embodiments. The pressure sealing apparatus used can be designed in accordance with the examples of FIGS. 1-6. First, an item can be placed into a hermetically sealable bag (e.g. an inner bag) in step 702. The hermetically sealable bag includes an exit valve the allows air to be removed from the hermetically sealable bag. Although the examples have focused on food items, it will be apparent that other items can also be placed into the inner bag for vacuum sealing. In step 704 the inner bag can be placed into a pressure container. In some embodiments, as in FIG. 5, the inner bag can be integral with the pressure container (e.g. an outer bag), so step 704 does not apply in all embodiments. However, in embodiments where the bag is separate from the pressure container, the bag is placed inside the pressure container, which includes aligning the exit valve with the exit port of the pressure container to allow air to be removed from the hermetically sealable bag. In step 706 the hermetically sealable bag is then sealed, and the pressure container is also sealed. In embodiments where the hermetically sealable bag is integrally formed inside an outer bag, there may only be one seal to close, as in embodiments consistent with that of FIG. 5. In step 708 the pressure container, which can be an outer bag or rigid container, is then pressurized. The pressure container can be pressurized by simply blowing air into the pressure container, or in some embodiments an air pump may be used. In step 710, as a result of pressurizing the pressure container, air is forced out of the hermetically sealable bag due to the pressure in the pressure container. As a result, the bag becomes vacuum sealed. In step 712, in embodiments where the hermetically sealable bag is removable from the pressure container, the bag can then be removed for storage, and the pressure container can then be used to vacuum seal another bag.

In accordance with the embodiments and teachings herein, and pressure sealing apparatus includes a hermetically sealable bag having an exit valve is used to contain and seal an item. The hermetically sealable bag can then be placed or otherwise contained in a pressure container such that the exit valve passes through an exit port of the pressure container so that air can exit the hermetically sealable bag. With the hermetically sealable bag inside the pressure container, which is also sealed closed other than for an air passage into the pressure container, the pressure container is then pressurized, causing air to exit from the hermetically sealable bag through the exit valve. In this arrangement the pressure sealing apparatus provides the benefit of being able to simply vacuum seal food and other items without the need for an expensive pump sealing system, which further avoids the problem of other material such as liquids being forced out of the bag fouling a pump. Furthermore, because the disclosed pressure sealing system uses positive pressure surrounding the bag to be sealed, rather than suction at one point of the bag as in the prior art, air is more efficiently driven out of the hermetically sealable bag, reducing the potential for trapped air pockets which can occur in negative pressure vacuum sealing systems.

What is claimed is:

1. A pressure sealing apparatus, comprising:

a hermetically sealable bag configured to accept an item and then to be sealed after the item is placed inside the hermetically sealable bag, and including an exit tube including an exit valve configured to allow air to escape from the hermetically sealable bag while preventing air from entering the hermetically sealable bag through the exit valve, the exit valve contained within the exit tube having a bottom that forms a shoulder, wherein the shoulder has a larger diameter than the tube;

a pressure container, configured to contain the hermetically sealable bag with the item therein under an airtight seal, and having and opening through which the hermetically sealable bag can be placed into the pressure container, a wall having an opening through which the exit tube containing the exit valve extends to allow air to exit from the hermetically sealable bag and external to the pressure container;

a nut that fits over the exit tube and compresses the hermetically sealable bag and the wall of the pressure container around the opening between the nut and the shoulder to form a seal; and an air passage formed in the wall of the pressure container configured to allow air to be provided into the pressure container, external to the hermetically sealable bag, in a manner that forces air out of the hermetically sealable bag through the exit valve.

2. The pressure sealing apparatus of claim 1, wherein the pressure container is also a hermetically sealable bag.

3. The pressure sealing apparatus of claim 1, wherein the pressure container is a rigid container.

4. The pressure sealing apparatus of claim 1, wherein the exit valve is configured to be removably coupled to the exit tube.

5. The pressure sealing apparatus of claim 1, wherein the air passage formed in the wall of the pressure container comprises a coupling for attachment to an air pump.

6. The pressure sealing apparatus of claim 1, wherein the hermetically sealable bag comprises a zip-close opening through which the item can be placed into the hermetically sealable bag.

7. The pressure sealing apparatus of claim 6, wherein the pressure container is a second bag, and wherein the hermetically sealable bag and the pressure container share the zip close opening.

8. A pressure sealing container, comprising:

a body;

a sealable opening formed on the body that can be open or closed, and when closed the opening is airtight;

an exit port in the body that is configured to accept an exit tube including an exit valve of a hermetically sealable bag while the hermetically sealable bag is inside the pressure sealing container such that the exit tube passes through the exit port; and an air passage formed in the body of the pressure container configured to allow air to be provided into the body, external to the hermetically sealable bag, in a manner that forces air out of the hermetically sealable bag through the exit valve.

9. The pressure sealing container of claim 8, wherein the exhaust exit port couples to the exit tube.

10. The pressure sealing container of claim 8, wherein the exit port is sized to allow a portion of the exit tube to extend through the exit port, external to the body, and to form a seal around the portion of the exit valve extended through the exit port.

11. The pressure sealing container of claim 10, further comprising a threaded nut configured to thread onto the portion of the exit tube configured to extend through the exit port, and form the seal through compression of the pressure sealing container around the exit port and the hermetically sealable bag between the nut and a shoulder formed at a bottom of the exit tube located inside the hermetically sealable bag.

12. The pressure sealing container of claim 8, further comprising a coupling at the air passage configured to connect to an air pump to pressurize the body.

13. The pressure sealing container of claim 8, wherein the body is comprised of a flexible polymeric material in a bag configuration, and wherein the sealable opening is a zip close opening.

14. The pressure sealing container of claim 8, wherein the body is rigid.

15. A method of sealing an item in a bag having a sealable opening and an exit valve that allows air to exit the bag when sealed and prevents air from thereafter entering the bag, the method comprising:

placing the item in the bag through a sealable opening of the bag;

placing an exit tube having an exit valve in the bag such that a shoulder at a bottom of the exit tube is inside the bag and the exit tube extend through an exit port of the bag;

sealing the sealable opening of the bag with the item inside the bag to provide a sealed bag;

placing the sealed bag including the item in a pressure sealing container such that the exit tube further extends through an exit port of the pressure sealing container;

placing a nut over the exit tube outside the pressure sealing container to compress the pressure sealing container and the bag around their respective exit ports between the nut and the shoulder at a bottom of the exit tube inside the bag; and pressurizing an interior of the pressure sealing container, thereby causing air to be expelled from the bag through the exit valve, external to the pressure sealing container and producing a vacuum effect inside the bag.

16. The method of claim 15, wherein sealing the opening of the bag comprises sealing a zip close opening of the bag.

17. The method of claim 15, wherein the pressure sealing container is a pressure sealing bag, placing the bag in the pressure sealing container comprises placing the bag in the pressure sealing bag.

18. The method of claim 15, further comprising, after pressurizing the interior of the pressure sealing container, releasing the pressure from the interior of the pressure sealing container and removing the bag containing the item, wherein an interior of the bag remains under the vacuum effect.

19. The method of claim 15, wherein pressurizing the interior of the pressure sealing container comprises adding air to the interior of the pressure sealing container to raise the pressure inside the pressure sealing container above an ambient atmospheric pressure.

* * * * *